United States Patent [19]

DeJonge

[11] Patent Number: 4,854,459

[45] Date of Patent: Aug. 8, 1989

[54] CONVERTIBLE CHILDPROOF/NON-CHILDPROOF CAP AND CONTAINER

[75] Inventor: Antonia R. DeJonge, Clinton Township, Hunterdon County, N.J.

[73] Assignee: Primary Delivery Systems, Inc., Annandale, N.J.

[21] Appl. No.: 272,814

[22] Filed: Nov. 18, 1988

[51] Int. Cl.[4] ..... B65D 55/02

[52] U.S. Cl. ..... 215/220; 215/219

[58] Field of Search ..... 215/218, 219, 220, 221

[56] References Cited

U.S. PATENT DOCUMENTS

| | | | |
|---|---|---|---|
| 2,772,803 | 12/1956 | Pasquariello | 215/219 |
| 3,138,277 | 6/1964 | Milbourne | 215/219 |
| 3,160,301 | 12/1964 | Milbourne | 215/219 |
| 3,311,247 | 3/1967 | Rigor | 215/221 |
| 3,370,731 | 2/1968 | Ehrbar | 215/219 X |
| 3,394,830 | 7/1968 | Schiavo | 215/220 |
| 3,396,864 | 8/1968 | Jones et al. | 215/220 X |
| 3,520,435 | 7/1970 | McIntosh | 215/220 |
| 3,578,192 | 5/1971 | Sonne | 215/221 |
| 3,625,387 | 12/1971 | Schaefer | 215/219 X |
| 3,878,961 | 4/1975 | Curry et al. | 215/219 |
| 4,281,771 | 8/1981 | Siegel | 215/220 |
| 4,690,292 | 9/1987 | Henning | 215/219 |

*Primary Examiner*—Stephen Marcus
*Assistant Examiner*—Nova Stucker
*Attorney, Agent, or Firm*—Kenneth P. Glynn

[57] ABSTRACT

The present invention involves a container and cap which is generally childproof and may be rendered non-childproof permanently. The invention involves a container having a cylindrical neck at the top and threads molded about the exterior of the neck as well as an inner cap and outer cap. The inner cap has a top and cylindrical side wall with threads molded on the inside of the side wall so as to mate with the threads of the container. The top or side of the inner cap has ratchet type segments on its outside and the outer cap has ratchet type segments on the inside of its top or side. The outer cap has a cylindrical side wall and is usually freely rotatable about the inner cap so as to be childproof. When in the childproof configuration as described, downward pressure is required by the user so as to engage the two rachet type segments and thereby engage the two caps to permit opening. Further, the outer cap has an opening in its side wall at a level near the bottom of the side wall of the inner cap and also has integrally attached thereto a flexible connector and stop. The flexible connector and stop are located so as to permit insertion of the stop into the opening so as to extend beyond the opening and push up the inner cap so as to permanently lock it into a position wherein the inner cap and outer cap ratchet type segments are permanently engaged. This renders the cap permanently non-childproof.

15 Claims, 2 Drawing Sheets

CONVERTIBLE CHILDPROOF/NON-CHILDPROOF CAP AND CONTAINER

BACKGROUND OF THE INVENTION

1. Field of the Invention

The present invention involves a safety cap and container which may be used for chemicals, medicine such as pills, capsules, caplets and the like and for other materials which require safety caps. More specifically, the present invention involves a convertible child-resistant or childproof cap and container which may be converted to a non-childproof cap and container. Thus, as used herein a child-proof cap and container is one which is designed to slow down or discourage or prevent a child from opening the bottle or container to which the cap is attached. The term "child-resistant" is also used interchangeably with childproof. The cap and container of the present invention may be either child-resistant or non-child-resistant depending upon the particular desires of the user, and, in many instances, may be predetermined and preset even before the container reaches the user, e.g. as in the case of prescription medicine wherein the pharmacist may actually render the cap and bottle permanently childproof or permanently non-childproof.

2. Prior Art Statement

For many years now, chemical and medicine container manufacturers, including prescription drug container manufacturers and over the counter labeled medicine container manufacturers have sought to create various cap configurations which would allow the ultimate users to have childproof or child-resistant caps. The most popular type of child-resistant caps are those which involve two cap systems, that is, arrangements involving one cap being located within the second cap, an outer cap being freely rotatable about an inner cap, with the inner cap having threads for the bottle, whereby the outer and inner cap become engaged by pressure from the user such as squeezing the side or pressing the top. In fact, the predominant childproof cap in the United States is one which involves downward pressure on an outer cap so as to engage ratchet type segments on the inside of the outer cap top and the outside of the inner cap top so that they rotate together so as to effect opening of the bottle. Thus, U.S. Pat. No. 3,878,961 to Curry et al is typical of the child-resistant closures requiring pressure from the user to open.

Other prior art of the past three decades show safety caps or closures which involve realignment of sliders or buttons so as to lock an outer cap into an inner cap using pressure. Thus, U.S. Pat. No. 2,772,803, issued to Pasquariello; U.S. Pat. No. 3,311,247 issued to Rigor and U.S. Pat. No. 3,578,192 issued to Sonne, all show some type of slider button which has an engage-disengage arrangement as mentioned. The problem arises, however, when children understand how to simply push the button and the container is no longer childproof.

U.S. Pat. No. 3,138,277 issued to B. K. Milbourne on June 23, 1964 is directed to a unique safety closure system involving an outer cap and an inner cap whereby the two caps are typically not engaged so the child can not open the container but by removal and reinsertion of a plug with a pin, the pin may be relocated from an inner circle to an outer area where it is fitted into a hole and engages the outer and inner caps so as to operate in an engaged fashion for opening and closing.

The Milbourne teaching is more complicated than a push button type closure described above but may be accidently left in the engaged position so the child would readily be able to open the cap and bottle. Further, because the plug is removable, it may becmoe lost and therefore render the bottle unopenable.

U.S. Pat. No. 4,690,292 issued on Sept. 1, 1987 to John Henning described a safety closure which includes an inner cap and an outer cap and various groves in which a lug is free to move and having various abutments so as to allow the user to create options as to locking and unlocking of the safety closure. While this teaching is more complicated and requires more significant manufacturing details than the closures described above, the use of the movement of the slider or lug is still within the skill of some children and may be rendered non-child-proof.

U.S. Pat. No. 3,160,301 issued to B. K. Milbourne on Dec. 8, 1964 describes a container or bottle and safety cap which has attached to the outer cap a key which is inserted into a slot and, when this slot is aligned with a slot on the inner cap, the key locks the two caps into position for opening of the container. Otherwise, when the key is not engaged, the outer cap freely rotates about the inner cap and the container is childproof. However, it should be noted that the key is not difficult to operate nor would it be difficult for a child to figure out, and thus render the container non-child-proof.

While all the prior art described above creates various improvements in the art of safety closures, it should be noted that the simple pressure or push down type cap remains the predominant cap in the industry due to its oustanding safety record. While children may, with some intelligence, figure out various key and slider type closure arrangements, they simply do not have the strength to open the simple two cap system that requires substantial downward pressure. Thus, while the prior art is directed to locking and unlocking of closures for usage, they do not teach the present invention cap and container which involves permanently locking a pressure type childproof cap into a non-childproof configuration.

SUMMARY OF THE INVENTION

The present invention involves a container and cap which is generally childproof and may be rendered non-childproof permanently. The invention involves a container having a cylindrical neck at the top and threads molded about the exterior of the neck as well as an inner cap and an outer cap. The inner cap has a top and a cylindrical side wall with threads molded on the inside of the side wall so as to mate with the threads of the container. The top or side of the inner cap has ratchet type segments on its outside and the outer cap has ratchet type segments on the inside of its top or side. The outer cap has a cylindrical side wall and is usually freely rotatable about the inner cap so as to be childproof. When in the childproof configuration as described, downward pressure is required by the user so as to engage the two sets of ratchet type segments and thereby engage the two caps to permit opening. Further, the outer cap has an opening in its side wall at a level near the bottom of the side wall of the inner cap and also has integrally attached thereto a flexible connector and stop. The flexible connector and stop are located so as to permit insertion of the stop into the opening so as to extend beyond the opening and push up or wedge the inner cap so as to lock it into a position wherein the inner cap and outer cap ratchet type segments are permanently engaged. This renders the cap permanently non-childproof.

BRIEF DESCRIPTION OF THE DRAWINGS

The present invention is more fully understood when the present specification is taken in conjunction with the drawings, wherein.

DETAILED DESCRIPTION OF THE INVENTION AND DRAWINGS

The present invention is, as indicated directed to a container and cap which is generally childproof and may be converted to a non-childproof mode. The prior art discussed above does involve the utilization of various techniques for engaging an inner cap to an outer cap so as to allow the opening of the cap. However, in no case is there disclosed permanenet engagement nor is there disclosed a technique whereby the inner cap may be the conventional inner cap which is utilized broadly throughout the trade, without modification thereto. In other words, the present invention not only serves a different purpose, i.e. the ability to permanently convert to non-childproof, but also functionally operates so as to lift up the inner cap rather than to be inserted into the inner cap. However, even more significant is the fact that the prsent invention is directed to a system of cap and bottle which allows the pharmacist to predetermine whether the cap should be permanently childproof or permanently non-childproof. Thus, in the case of adults with no children in the home, or more importantly, persons with arthritis, muscular difficulties, extreme physical weakness and others who require medicine who are unable to open the pressure cap type childproof containers may have these converted at the pharmacist to non-childproof caps by simple permanent insertion of the stop. Further, to make the cap non-childproof the pharmacist need merely tear away the flexible connector and stop, or in the case where there is no permanent connection, not provide a stop to the user. Last, the pharmacist may elect not to make the decision, or the present invention may be used in conjunction with prepackaged medicines and the ultimate user may either discard the stop or insert the stop so as to have a childproof or non-childproof cap.

Figure 1:
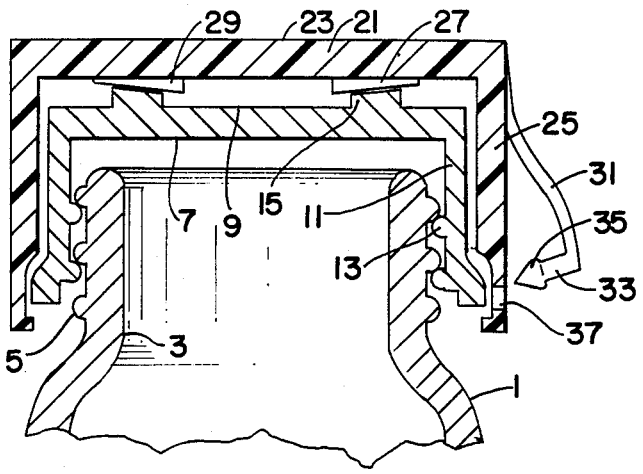
FIG. 1 shows a cut side view of a medicine bottle and cap of the present invention.

Refering now more particularly to FIG. 1, there is shown a container 1 formed typically of molded plastic, which has a cylindrical neck 3 at the top and threads 5 molded about the exterior of the neck 3. Inner cap 7 has a top 9 and a side wall 11 and threads 13 are located on the interior of side wall 11 so as to mate with the threads 5 of container 1. Inner cap 7 also contains ratchet type segments which are typically shown as segment 15. Outer cap 21 has cylindrical side wall 25 and top 23 with ratchet type segments 27 and 29 as typical which are lcoated on the underside or inside of top 23 of outer cap 21 flexible connector 31, which in this case is a strp or cord, includes stop 33 which has an enlarged end 35. Side wall 25 includes opening 37 for insertion of stop 33 and opening 37 is located at a level below side wall 11 of inner cap 7 so that upon insertion, inner cap 7 is lifted up and the ratchet type segments 15 engage with ratchet type segments 27 so as to engage the inner cap 7 and outer cap 21 for easy non-childproof opening and closing of the cap and its container system of the present invention.

Figure 2:
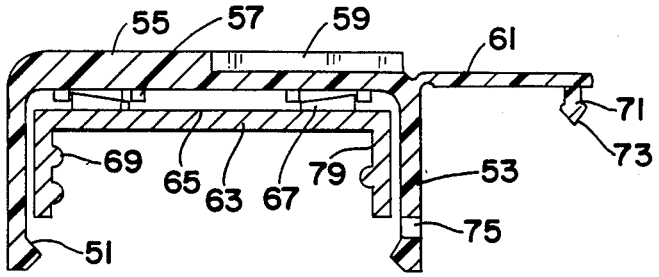
FIG. 2 shows a cut side view of an alternative embodiment of the present invention involving a flap and shows the inner and outer caps without the bottle.
Figure 3:
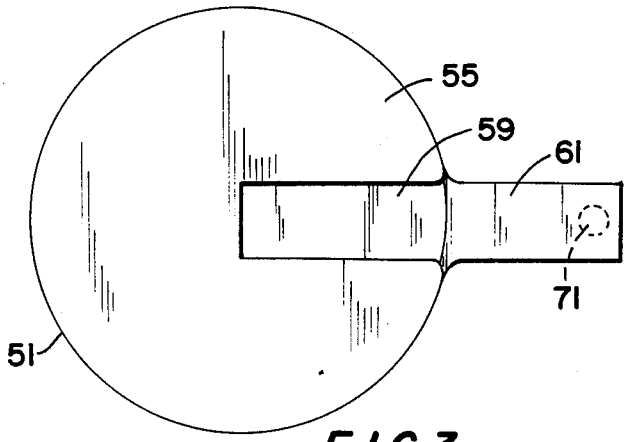
FIG. 3 shows a top view of the outer cap and flap which is shown in FIG. 2.
Figure 4:
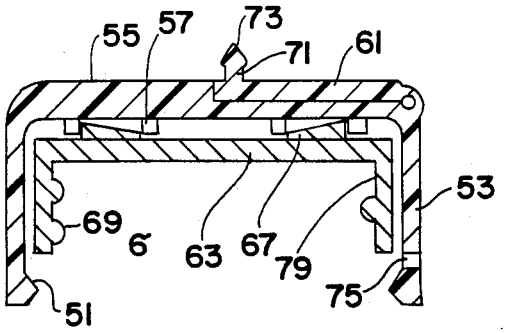
FIG. 4 shows a side cut view of the present invention cap shown in FIG. 2 but with the flap in the secured, non-engaged position.
Figure 5:
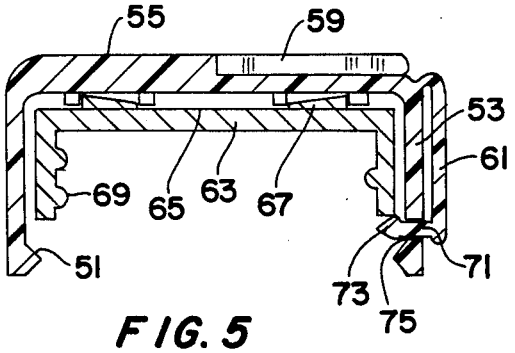
FIG. 5 shows a side cut view of the present invention cap shown in FIG. 2 but with the flap down into the engaged position whereby it is pushing up on the inner cap as shown.

FIGS. 2,3,4 and 5 show an alternative embodiment of the present invention and like parts are like numbered throughout FIGS. 2,3,4 and 5. As shown in these figures, inner cap 63 has a top 65 with ratchet type segments represented by segment 67 and side wall 79 with threads 69 located on the interior of side wall 79 for engagement with a container (not shown). Outer cap 51 includes a top 55 and a side wall 53 as well as ratchet type segments represented by segment 57. Opening 75 is located in side wall 53 as shown. Cut into the top of the top 55 of outer cap 51 which is illustrated in FIGS. 2 and 3 most clearly is recess 59 which is designed to have flexible connector 61 nested therein as shown in FIG. 4. Flexible connector 61 in this case is a flap and includes stop 71 which has an enlarged conical end 73. Thus, FIGS. 2 and 3 show a side cut view and top view respectfully of inner cap 63 and outer cap 51 with flexible connector 61 in the free hanging position. FIG. 4 shows flexible connector 61 nested and FIG. 5 shows flexible connector 61 in a down position with stop 71 inserted and conical end 73 acting to both lift up inner cap 63 so as to engage inner cap 63 with outer cap 51 and also, due to the enlarged size of conical end 73 creates a permanent insertion in that it takes intentional pulling to be removed from opening 75.

Figure 6:
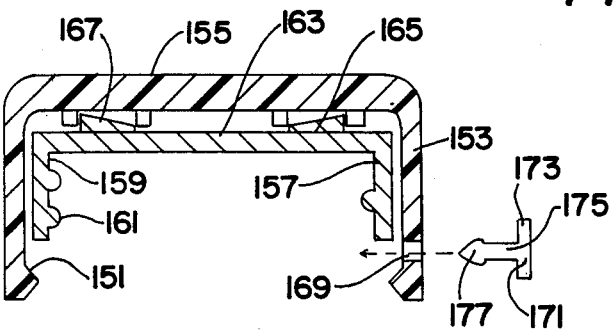
FIG. 6 shows a side cut view of the present invention cap which has an unconnected stop so as to engage the inner cap and the outer cap in accordance with the present invention; and, FIG. 7 shows an alternative embodiment of a non-attached stop which could be used in conjunction with the inner cap and outer cap shown in FIG. 6 above.

Refering now to FIG. 6, there is shown outer cap 151 having side wall 153 and top 155. Innercap 157 has side wall 159, threads 161, top 163 and ratchet type segments exemplified by ratchet type segments 165. These ratchet type segments such as 165 mesh ratchet type segments such as 167 located on the inside of top 155 of outer cap 151. Outer cap 151 also has an opening 169 and non-attached stop 171 has a thumb push flange 173, a stem 175 and an enlarged tip 177. When stop 171 is not inserted into opening 169 outer cap 151 is free floating relative to inner cap 157 except when outer cap 151 is pressed down upon for engagement of the ratchet type segments. In this mode, the cap is considered childproof. By permanent insertion of stop 171 into opening 169, inner cap 157 is pushed upwardly against outer cap 151 and the ratchet segments are permanently engaged, rendering the cap non-childproof.

Figure 7:
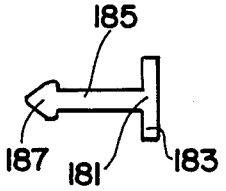

FIG. 7 shows an embodiment of a non-attached stop which is shown generally as stop 181 and has a thumb push flange 183, stem 185 and enlarged tip 187. In this embodiment, stop 181 may be used in conjunction with the cap shown in FIG. 6 but, due to the specific design of tip 187, when stop 181 is inserted in opening 189, it will not fall out but may be removed to reconvert the cap back into the childproof mode, e.g. when grandparents have grandchildren visiting for extended periods of time.

Obviously, numerous modifications and variations of the present invention are possible in light of the above teachings. It is therefore understood that within the scope of the appended claims, the invention may be practiced otherwise than as specifically described herein. For example, as mentioned, the ratchet type segments may be located on the inside wall of the outercap and the outside of the wall of the inner cap without exceeding the scope of the present invention.

What is claimed is:

1. A container and a cap therefor which is generally childproof, which comprises:

(a) a container having a cylindrical neck at the top and threads molded about the exterior of said neck;

(b) an inner cap having a top and a cylindrical sidewall, having threads molded about the interior of said sidewall to interlock or mate with the threads of said container, said inner cap having ratchet type segments located on its exterior; and (c) an outer cap having a top and a cylindrical sidewall, said top having ratchet type segments located on its interior so as to be engageable with the ratchet type segments of said inner cap, said outer cap being of a sidewall height greater than the inner caps, said outer cap being located and fitted loosely about the inner cap, said outer cap having an opening in said sidewall at a level near the bottom of the sidewall of said inner cap, said outer cap also having integrally attached thereto a flexible connector and a stop located so as to permit the stop to be inserted into said opening and push up said inner cap to lock it into a position wherein the inner cap and outer cap ratchet type segments are engaged and the outer cap can no longer be freely rotatable about the inner cap, thus, (i) being a childproof container and cap when said stop is not inserted due to the free rotation of the outer cap about the inner cap except when the outer cap is pushed down onto the inner cap and simultaneously rotated; and, (ii) being a non-childproof container and cap when the stop is inserted into the opening to lock the inner cap and outer cap into a ratchet type segment engaged position.

2. The container and cap of claim 1 wherein said flexible connection is a flap which is removably insertable into the exterior of the top of the outer cap and is attached to the cap at the edge of the top and has a peg for a stop at the end opposite from which the flap is attached, said flap being of a predetermined length so that when it is rotated outwardly about 270°, the peg is insertable into the opening of the outer cap to lock the inner cap and outer cap together.

3. The container and cap of claim 2 wherein said peg is cylindrical with an enlarged diameter cone at its insertable end so that it may not be removed after insertion.

4. The container and cap of claim 1 wherein said stop has the configuration of an arrow and the arrowhead is of significant size so that it may not be removed after insertion.

5. The container and cap of claim 1 wherein said flexible connector is a strip of plastic which is tearably removable from said outer cap.

6. The container and cap of claim 5 wherein said flexible connector is integrally molded with said outer cap and wherein said stop is a peg.

7. The container and cap of claim 6 wherein said peg is cylindrical with an enlarged diameter cone at its insertable end so that it may not be removed after insertion.

8. The container and cap of claim 5 wherein said stop has the configuration of an arrow and the arrowhead is of significant size so that it may not be removed after insertion.

9. The container and cap of claim 1 wherein said flexible connector and stop are a single continous strip of plastic.

10. The container and cap of claim 9 wherein said strip of plastic is cylindrical.

11. The container and cap of claim 9 wherein said strip of plastic is cylindrical with an enlarged diameter cone at its insertable end so that it may not be removed after insertion.

12. A container and a cap therefor which is generally childproof, which comprises:

(a) a container having a cylindrical neck at the top and threads molded about the exterior of said neck;

(b) an inner cap having a top and a cylindrical sidewall, having threads molded about the interior of said sidewall to mate with the threads of said container, said inner cap having ratchet type segments located on its exterior;

(c) an outer cap having a top and a cylindrical sidewall, said cap having ratchet type segments located on its interior so as to be engageable with the ratchet type segments of said inner cap, said outer cap being located and fitted loosely about the inner cap, said out cap having an opening in said sidewall at a level near the bottom of the sidewall of said inner cap; and, (d) a stop capable of being inserted into said opening so as to extend beyond said opening and push up said inner cap to lock it into a position wherein the inner cap and outer cap ratchet type segments are engaged and the outer cap can no longer be freely rotatable about the inner cap, thus, (i) being a childproof container and cap when said stop is not inserted due to the free rotation of the outer cap about the inner cap except when the outer cap is pushed down onto the inner cap and simultaneously rotated; and, (ii) being a non-childproof container and cap when the stop is inserted into the opening to lock the inner cap and outer cap into a ratchet type segment engaged position.

13. The container and cap of claim 12 wherein said stop is a peg which is insertable into the opening of the outer cap to lock the inner cap and outer cap together.

14. The container and cap of claim 13 wherein said peg is cylindrical with an enlarged diameter cone at its insertable end so that it may not be removed after insertion.

15. The container and cap of claim 13 wherein said stop has the configuration of an arrow and the arrowhead is of significant size so that it may not be removed after insertion.

* * * * *